US005718298A

United States Patent [19]

Rusnak

[11] Patent Number: 5,718,298

[45] Date of Patent: Feb. 17, 1998

[54] SEPARATION SYSTEM AND METHOD FOR SEPARATING THE COMPONENTS OF A DRILL BORE EXHAUST MIXTURE

[76] Inventor: Jerry A. Rusnak, 3311 Southview Dr., Fort Smith, Ak. 72903

[21] Appl. No.: 630,365

[22] Filed: Apr. 10, 1996

[51] Int. Cl.[6] ..... E21B 21/06

[52] U.S. Cl. ..... 175/66; 166/267

[58] Field of Search ..... 166/267, 265, 166/357; 175/66

[56] References Cited

U.S. PATENT DOCUMENTS

| | | | |
|---|---|---|---|
| 1,847,864 | 3/1932 | Cross | 175/66 |
| 2,730,333 | 1/1956 | Lenhart, Jr. et al. | 255/50 |
| 2,740,609 | 4/1956 | Richardson et al. | 255/50 |
| 3,547,190 | 12/1970 | Wilkerson | 166/267 X |
| 3,811,518 | 5/1974 | Kalaf et al. | 175/60 |
| 4,023,942 | 5/1977 | Brady et al. | 55/241 |
| 4,100,982 | 7/1978 | Wilkinson et al. | 175/206 |
| 4,243,528 | 1/1981 | Hubbard et al. | 210/104 |
| 4,277,263 | 7/1981 | Bergeron | 55/282 |
| 4,354,559 | 10/1982 | Johnson | 175/71 |
| 4,434,861 | 3/1984 | Howeth | 175/66 |
| 4,484,643 | 11/1984 | Mahyera et al. | 175/206 |
| 4,661,127 | 4/1987 | Huntley | 166/267 X |
| 4,779,677 | 10/1988 | Cobb | 166/267 X |
| 5,093,008 | 3/1992 | Clifford, III | 175/66 X |
| 5,129,468 | 7/1992 | Parmenter | 175/66 |
| 5,149,344 | 9/1992 | Macy | 166/267 X |
| 5,335,728 | 8/1994 | Strahan | 166/267 |
| 5,415,776 | 5/1995 | Homan | 210/519 |
| 5,454,957 | 10/1995 | Roff | 175/664 X |
| 5,570,744 | 11/1996 | Weingarten et al. | 166/357 |

*Primary Examiner*—Frank Tsay
*Attorney, Agent, or Firm*—Dougherty & Hessin, P. C.

[57] ABSTRACT

A separation system for use with wells drilled for the purpose of producing hydrocarbons where the primary drilling fluid is air or mist. The separator system includes a horizontal separation tube connected to an exhaust line so that it will receive the exhaust mixture created during the drilling of the well. The separator tube has separator inlet liquid ports defined along the length of the tube. Dump outlet ports are also defined along the length of the tube. Separator liquid is injected into the tube and the solid and liquid components of the exhaust mixture along with the separator liquid will pass out of the tube through the dump outlet ports into a receiving tank. The gas component of the exhaust mixture passes through the separator tube into a secondary separator.

23 Claims, 6 Drawing Sheets

SEPARATION SYSTEM AND METHOD FOR SEPARATING THE COMPONENTS OF A DRILL BORE EXHAUST MIXTURE

BACKGROUND OF THE INVENTION

This invention generally relates to a separation system and more particularly to a separation system for separating the exhaust mixture created during the drilling of a wellbore.

Wellbores drilled for the production of hydrocarbons (i.e., natural gas and/or oil), are commonly drilled using one of several types of drilling fluids. The most prevalent drilling fluid used is a liquid such as, but not limited to, drilling mud, water or oil. At times, a wellbore for the production of hydrocarbons is drilled using air or some other gas as the drilling fluid. For instance, air or gas drilling is done typically when the underground formations are competent enough to not collapse without an incompressible fluid in the wellbore and when the produced flow of liquid and gasses out of the wellbore can be safely and economically handled at the surface by conventional means. Wellbores are also mist drilled, which simply means that water, or water mixed with soap, is injected into the drilling air stream to create the mist used as the drilling fluid. To drill with air or mist, air is circulated down the drill string, out the drill bit and up the annulus between the drill string and the wellbore. The air is typically circulated utilizing large air compressors.

The exhaust mixture from the wellbore will typically comprise the air or mist used to drill the well, solid drill cuttings from the wellbore, and any natural gas, water or other fluid encountered during the drilling operation. The air and the drill cuttings are carried up the annulus and are generally blasted out through an exhaust line, typically called a "blooie line" which is simply a piece of pipe and which is run out to an open waste pit. Any natural gas, water or other fluid encountered during drilling will likewise pass out of the well annulus into the blooie line and out to the waste pit.

Once drilling is complete, the waste pit must be cleaned up. Because of the large quantities of drill cuttings, water and other fluid generated during drilling, the waste pit is quite large and is expensive and burdensome to clean up. However, each time a well is air-drilled, the waste pit must be cleaned up due to environmental and health hazards which would otherwise be created. The waste pit cannot be cleaned up until drilling is completed.

To clean the open waste pit, the liquids are typically "sucked" out of the pit using a vacuum truck and transported to a commercial disposal site. The sludge (i.e., solid and liquid mixtures, such as water and dirt) is then dredged out and hauled to a disposal site or chemically treated to absorb the remaining liquid. The pit is then filled with soil. Although some of the liquid can be removed during drilling, the pit cannot be completely cleaned, filled and leveled or there will be no containment of the waste from the well.

Thus, there is a need in the art for a system which will eliminate the large open waste pit, and which provides for removal of the solid and liquid waste as the wellbore is being drilled.

SUMMARY OF THE INVENTION

The separation system of the present invention eliminates the large open waste pit associated with prior art wells and provides a "closed system" wherein solids are contained in a smaller area and periodically removed from the well site. The invention includes a horizontal separation tube, or chamber, for receiving an exhaust mixture created during the drilling of a wellbore in which air, or some other gas, or mist is the primary drilling fluid. Typically, the exhaust mixture will comprise a solid component, which will include drill cuttings, a gas component, which will include the air or other gas utilized as a drilling fluid and natural gas encountered during drilling, and a liquid component comprised of water or other liquid encountered during the drilling process along with the liquid utilized during "mist" drilling. When only air is used, it is possible that the exhaust mixture will not include a liquid component, since the well at some depths may not produce liquid during drilling. The separation tube will separate the exhaust mixture into its component liquid, solid and gas parts.

The horizontal separation tube has an entrance end, an exit end, a length and a central flow passage. The separation tube is connected to an exhaust or blooie line at its entrance end so that the wellbore exhaust mixture is received in the horizontal separation tube from the blooie line. The exhaust mixture is received in the central flow passage of the horizontal separation tube and flows in a direction from the entrance end to the exit end.

A separator liquid inlet port is defined in the horizontal separation tube and communicates with the central flow passage. The liquid inlet port preferably comprises one of a plurality of liquid inlet ports defined in the horizontal separation tube along the length of the tube. The inlet ports are spaced, and are preferably equally spaced, along the length of the separator tube. A separator liquid may be injected into the central flow passage through each liquid inlet port.

A dump outlet port, which is preferably one of a plurality of dump outlet ports, is defined in the separation tube along the length thereof. The separator liquid injected through the liquid inlet ports will interact with the exhaust mixture so that the separator liquid, and the solid component of the exhaust mixture along with any liquid component of the exhaust mixture will pass out of the horizontal separator tube through the dump outlet ports. Air or other gas utilized to drill the wellbore along with any natural gas component of the exhaust mixture will pass through the horizontal separation tube from the entrance end to the exit end.

A secondary separator may be connected at the exit end of the horizontal separation tube for receiving the drilling air and the gas encountered during the drilling of the wellbore. The secondary separator will separate any residual solids and liquids remaining after the exhaust mixture has passed through the horizontal separation tube.

An adjustable inlet valve is communicated with each liquid inlet port. The inlet valves are adjustable from a range of fully open to fully closed. Thus, some inlet valves may be open while others are closed, and each valve can be adjusted to change the flow rate therethrough to any desirable flow rate.

The invention may further include a plurality of dump outlet valves, one communicated with each dump outlet. The dump outlet valves are operable from a fully open to a fully closed position and are preferably remotely operable. Thus, the valves may be moved from fully open to fully closed, and from fully closed to fully open from a location remote from the outlet valve itself.

A plurality of deflector plates is disposed in the central flow passage. The deflector plates will deflect the solid and any liquid components of the exhaust mixture along with the separator liquid to direct those components into the dump outlet ports. Each dump outlet port has a deflector plate corresponding therewith so that there are an equal number of deflector plates and dump outlet ports.

A receiving tank is positioned below the horizontal separation tube for receiving the drill cuttings and other solid components of the exhaust mixture along with the liquid components of the exhaust mixture and the separator liquid from the dump outlet ports. A jetting system is connected to the receiving tank.

The jetting system is communicated with the receiving tank and will remove the solids and liquids therefrom. The jetting system may include a shale shaker which will dewater and remove the solids from the receiving tank. The solids may then be dumped onto the ground while the liquid is recirculated back into the receiving tank. A recirculation pump may also be communicated with the receiving tank to recirculate the liquid in the receiving tank back to the liquid inlet ports. Any excess water can easily be transferred to a holding tank to be picked up and transported to a waste site while drilling is ongoing. Likewise, the solids can easily be picked up and transported to a waste site while drilling is ongoing.

The method of the present invention thus comprises directing the exhaust mixture created during the drilling of a wellbore into a separation tube, and injecting a separator liquid into the separation tube transverse to the flow direction of the exhaust mixture. The method further comprises removing the solids and any liquid components of the exhaust mixture from the separation tube between an entrance and exit of the separation tube as the exhaust mixture passes therethrough. The gas component of the exhaust mixture passes from the entrance to the exit end and may pass into a secondary separator. The separator liquid is injected so that it will interact with the exhaust mixture such that the solid and any liquid components of the exhaust mixture fall through openings in the bottom of the separation tube.

BRIEF DESCRIPTION OF THE DRAWINGS

FIG. 6 shows an end view of the invention, without a portion of the jetting system.

FIG. 8 shows a section view from line 8—8 on FIG. 5.

FIG. 9 shows a section view from line 9—9 on FIG. 7.

DETAILED DESCRIPTION OF THE PREFERRED EMBODIMENT

Figure 1:
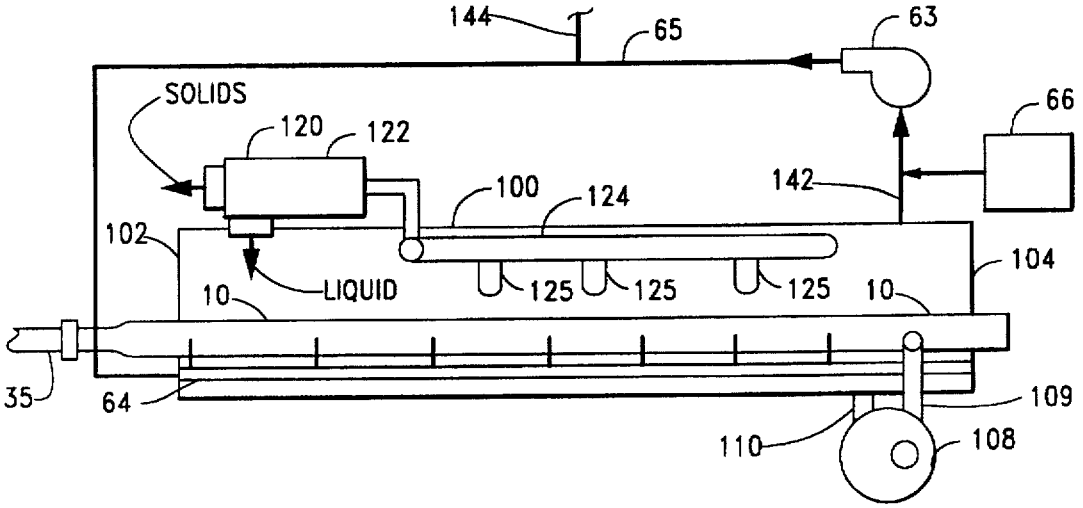
FIG. 1 schematically shows a top view of the present invention.
Figure 2:
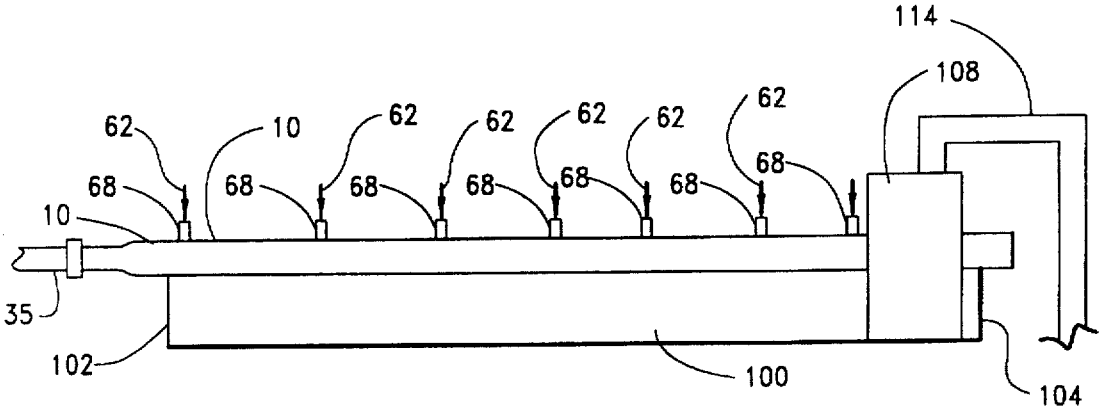
FIG. 2 schematically shows a side view of the present invention.
Figure 3:
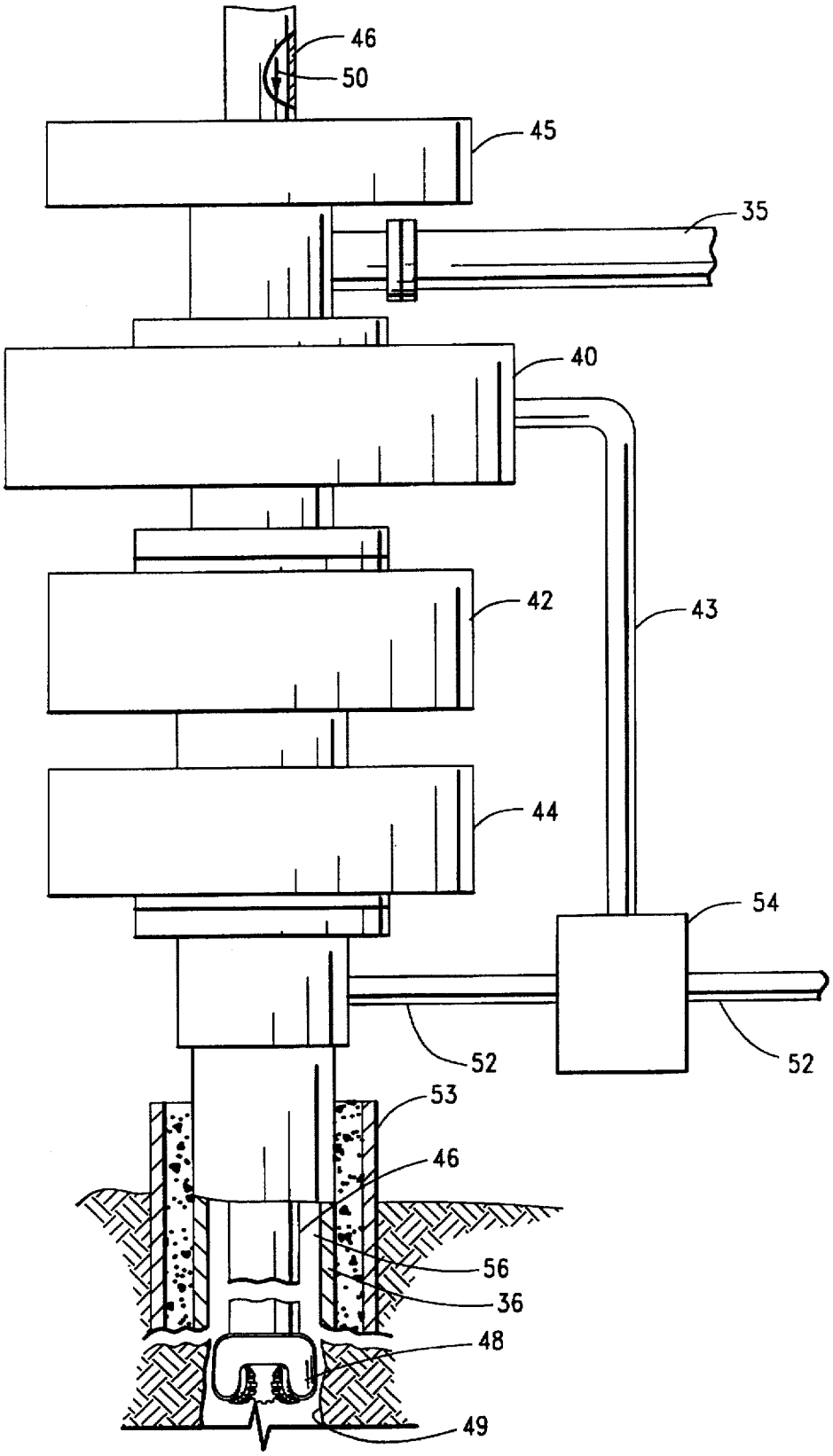
FIG. 3 shows a schematic of the exhaust line connection at the wellhead.

Referring now to the drawings and more particularly to FIG. 1, the separation system of the present invention is schematically shown and generally designated by the numeral 1. As shown in FIGS. 5–9, the separation system generally includes a horizontal separation tube or chamber 10. Separation tube 10 has an entrance end 15, an exit end 20, a length 25 and a central flow passage 30. The horizontal separation tube 10 is connected at its entrance end 15 to a blooie or wellbore exhaust line 35. As schematically shown in FIG. 3, the blooie line 35 may be connected at the wellhead above a series of preventers, which may include an annular preventer 40, a pipe ram preventer 42 and a blind ram preventer 44. As shown in the schematic, a drill string 46 extends downwardly at the wellhead through a rotating head 45 into a wellbore 49 drilled for the production of hydrocarbons. As known in the art, the rotating head allows the drill string to rotate and provides a seal around the drill string so that the exhaust mixture from the wellbore is directed into the blooie line.

Figure 4:
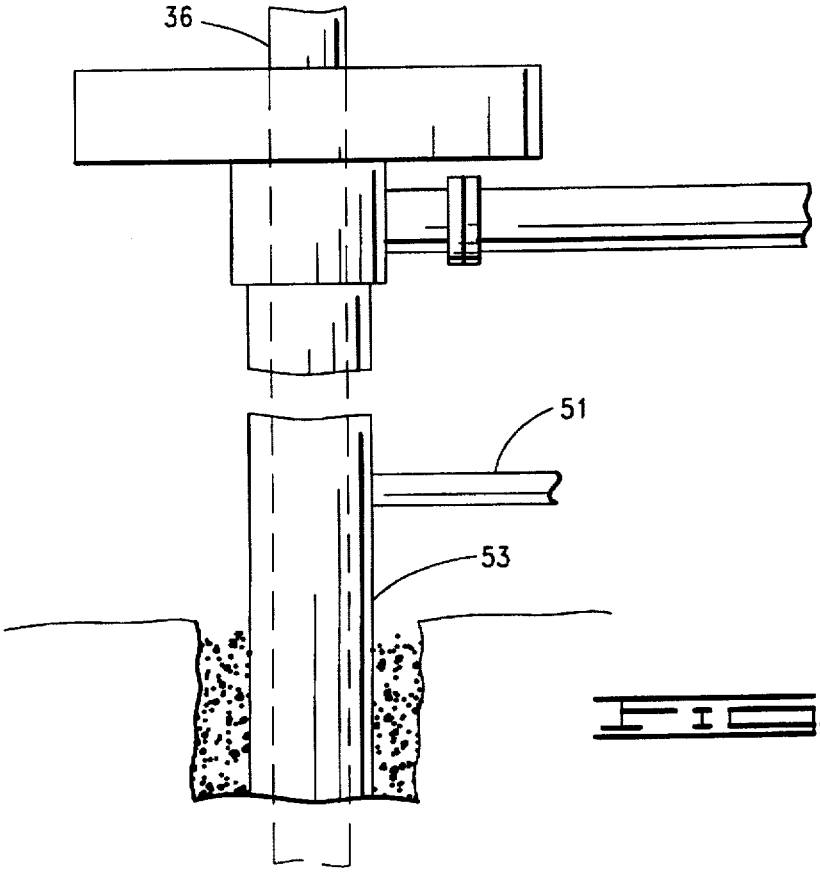
FIG. 4 shows a schematic of the wellhead prior to cementing of surface casing.

Drill string 46 has a bit 48 attached at the lower end thereof. The schematic shown in FIG. 3 depicts the wellbore after surface casing 36 has been cemented in a manner known in the art. As shown in the schematic in FIG. 4, when surface casing 36 is being set, an outlet for cement returns 51 should be communicated with a conductor pipe 53 since the blooie line 35, which could normally be utilized for cement returns, will be attached to horizontal separator tube 10. The schematic in FIG. 4 shows the well prior to the time the surface casing has been cemented and cut off.

Referring now back to the schematic in FIG. 3, a flow line 52 is communicated with the surface casing. The flow line will normally be closed while the wellbore is being drilled. The flow line 52 includes a hydraulically operated control valve 54. The valve is connected to annular preventer 40 with line 43 and is operably associated with the annular blowout preventer 40 such that when the valve is actuated, the annular blowout preventer closes to prevent flow therethrough, and the flow line 52 opens so the flow therethrough is established. Likewise, when flow line 52 is closed, annular blowout preventer 40 is open and flow to blooie line 35 is established.

Air 50 is circulated down the drill string 46 in a manner known in the art utilizing air compressors (not shown) or other means, and is circulated out the drill bit. The air passes out the drill bit and forces drill cuttings up an annulus 56 between wellbore 49 and drill string 46. The air and the drill cuttings will pass up the annulus and out blooie line 35 into entrance end 15 of horizontal separation tube 10. In addition to the drilling air or mist and solid drill cuttings, the exhaust mixture from the wellhead will include any liquids such as water encountered during the drilling process along with natural gas from the wellbore. The exhaust mixture will pass through the blooie line into the entrance end 15 of the horizontal separation tube.

The separation system includes a plurality of liquid inlet ports 60 defined in the horizontal separation tube. The inlet ports are communicated with central flow passage 30 so that a separator liquid 62, which preferably comprises water, may be injected therethrough. In the embodiment shown, the horizontal separation tube has seven liquid inlet ports 60 defined therein. A separator inlet manifold 64 is connected to an inlet pipe 65, which is connected to a separator liquid supply, or water supply 66. A circulating pump 63 is disposed in inlet pipe 65. Separator liquid is supplied to manifold 64 and passes through a plurality of inlet lines 68 through inlet ports 60. A fully adjustable liquid inlet valve 70 which may be comprised of a gate valve, is disposed in each inlet line 68 so that flow through each inlet port 60 may be adjusted from a fully open to a fully closed position and may also be adjusted to any desirable flow rate therebetween. The separator liquid is preferably injected into the central flow passage in a direction transverse to the flow direction 72 of the exhaust mixture which, as set forth previously, comprises drilling air or mist, drill cuttings and any liquid or natural gas encountered during the drilling of the well.

A plurality of dump outlet ports 80 are defined in the horizontal separation tube along the length thereof and are communicated with central flow passage 30. A dump outlet line 81 is communicated with each port 80, and includes a dump outlet valve 82, which may be comprised of a ball valve and which is operable from a fully open to a fully closed position. The valves may be remotely operable from the drilling rig, a part of which is schematically shown in FIG. 9, or other location. Thus, the invention may include pneumatic valve actuator 84 connected to each dump outlet valve 82. The actuators will be connected to an air supply line 86. The air may be supplied to each air supply line 86 from the drilling rig air supply (not shown), or from air compressors at other locations remote from the valve. Each air supply line has an on-off valve 88 disposed therein so that the air pressure can be applied to any or all actuators 84. The on-off valve will typically be located at the drilling rig.

When it is desired that a dump outlet valve 82 be moved to the open position, the on-off valve is moved to the "on"position, so that air is supplied to actuator 84 through line 86. The air pressure will cause a connecting rod 89 to turn which will move the dump outlet valve 82 to its open position so that solids and liquids passing through the separation tube will fall out of the tube through outlet ports 80. To close an outlet valve, the on-off valve is moved to the off position to shut off air to the actuator so that the dump outlet valve will close. Each valve 82 has its own air supply line 86 and on-off valve 88 so that the valves can be independently operated, to allow each valve to be opened and/or closed independent of other valves. The outlet area can thus be regulated by opening a desired number of outlet valves and closing other outlet valves.

A plurality of deflector plates, or baffles 90 are disposed in horizontal separation tube 10. The deflector plates are preferably positioned at an angle from a line 93 parallel to a vertical line 91 and are preferably rotated at an angle from line 91 in the direction of the flow of the exhaust mixture. Preferably, the invention has a deflector plate 90 corresponding to each dump outlet port 80 so that there are an equivalent number of deflector plates 90 and dump outlet ports 80. In the embodiment shown, the baffles are semicircular as shown in the cross section in FIG. 9. However, the baffles can be any shape that will fit in the central flow passage and that will deflect the solids and liquids flowing therethrough.

The exhaust mixture will be received in the entrance end 15 of the horizontal separation tube. As the exhaust mixture passes therethrough, separator liquid 62 will be injected into the central flow passage 30 through inlet ports 60. The solid component of the exhaust mixture, which will include the drill cuttings, along with any liquid component of the exhaust mixture will interact with the separator liquid so that the separator liquid, the solid component of the exhaust mixture and any liquid component of the exhaust mixture will pass out of the separation tube 10 through the dump outlet ports 80. Each component will obviously pass out of the separation tube only through the ports 80 and lines 81 in which the valve 82 has been moved to its open position. Any number of the valves can be open, from one to all of the valves, depending upon the amount of outlet area needed to allow the solid and liquid components of the exhaust to pass out of the separation tube. The drilling air and any natural gas encountered during the drilling procedure will flow to the exit end of the horizontal separation tube.

The invention further includes a receiving tank 100 positioned beneath the dump outlet ports for receiving the solids and liquids passing therethrough. Horizontal separation tube 10 may be supported on the ends 102 and 104 of the receiving tank. A plurality of tube supports 106 extending upward from the bottom of the receiving tank 100 may also be utilized to support the horizontal separation tube.

A secondary separator 108 is included at the exit end of the horizontal separation tube. The secondary separator is communicated with the central flow passage through pipe 109 so that the drilling air, natural gas encountered during drilling and any residual liquids or solids pass into the secondary separator. The secondary separator may comprise a vertical separator of a type known in the art, and will separate the drilling air and natural gas from the residual liquids and solids. The liquids and solids can be communicated back into the receiving tank through conduit 110 or can simply be periodically cleaned from the bottom of the secondary separator through a waste port, or dump valve 112. The air and natural gas will be vented through the top of the separator and will pass through a gas line 114 to a burn pit (not shown) where the natural gas can be vented.

Figure 5:
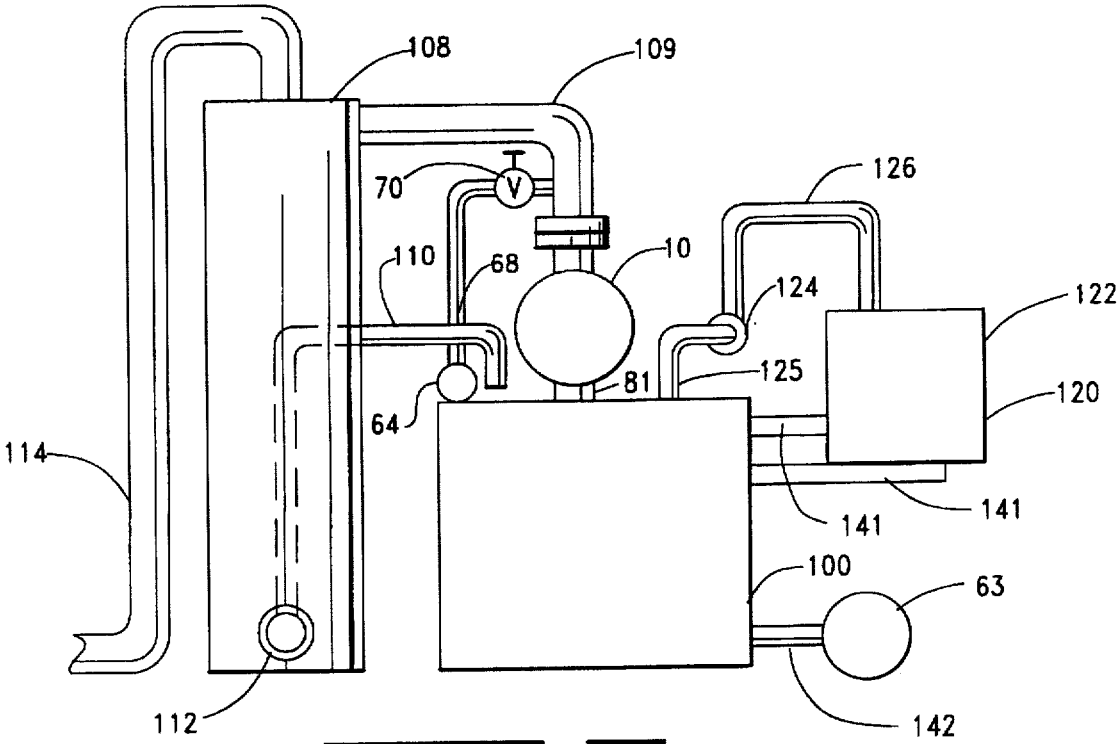
FIG. 5 shows a top view of the invention without the secondary separator, and without a portion of the jetting system.
Figure 5:
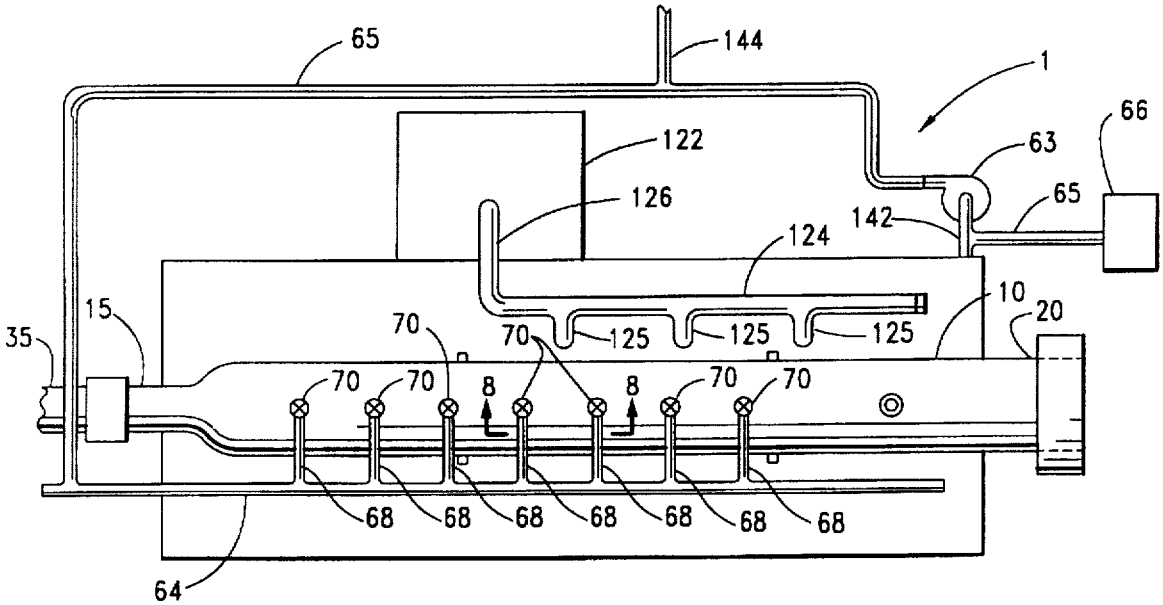
Figure 7:
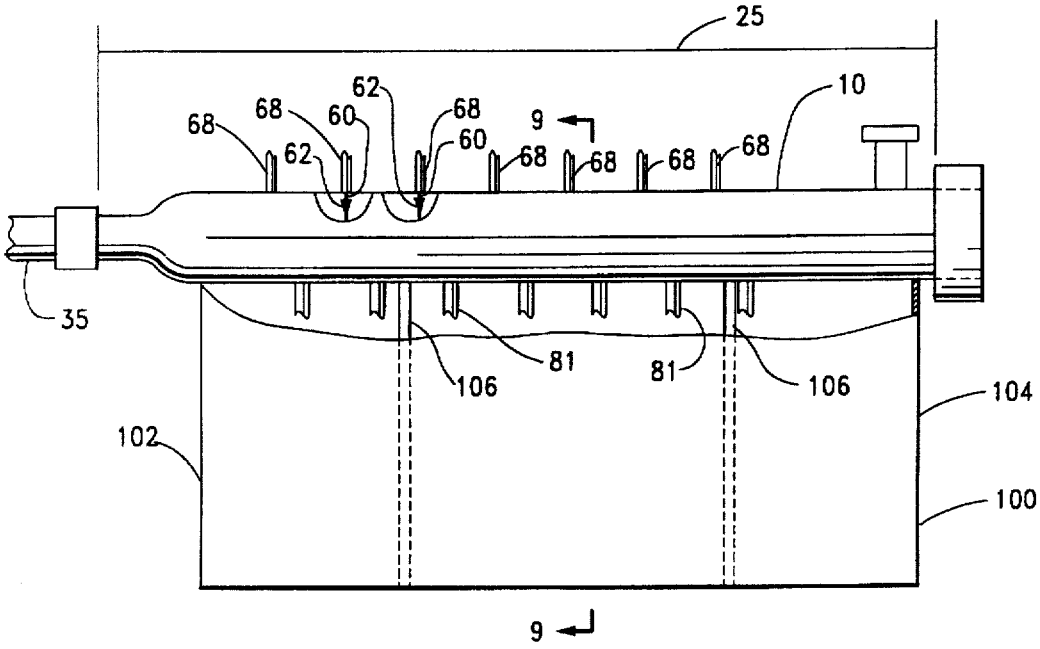
FIG. 7 shows a side partial section view of the invention without the secondary separator and without the liquid inlet manifold.
Figure 5:
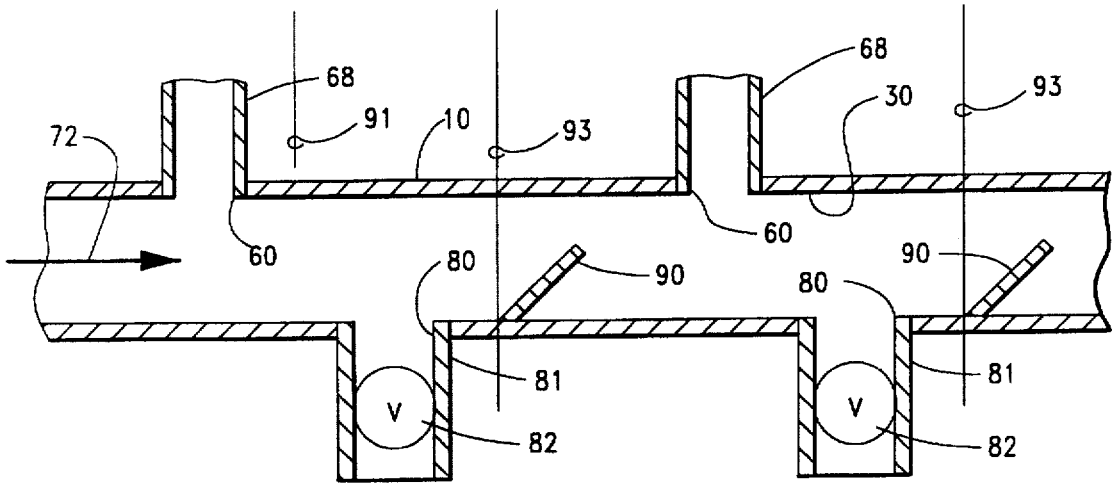
Figure 3:
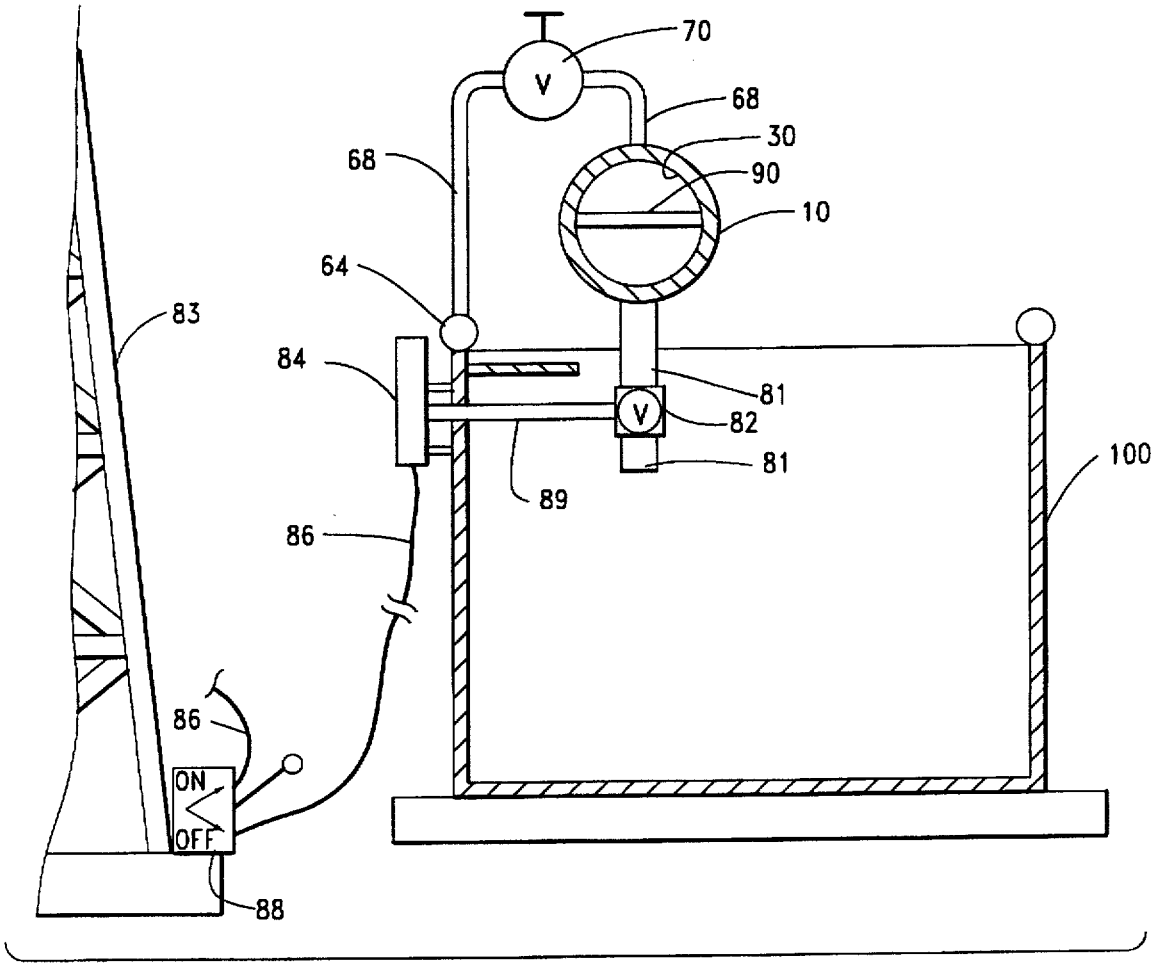
Figures 10, 11:
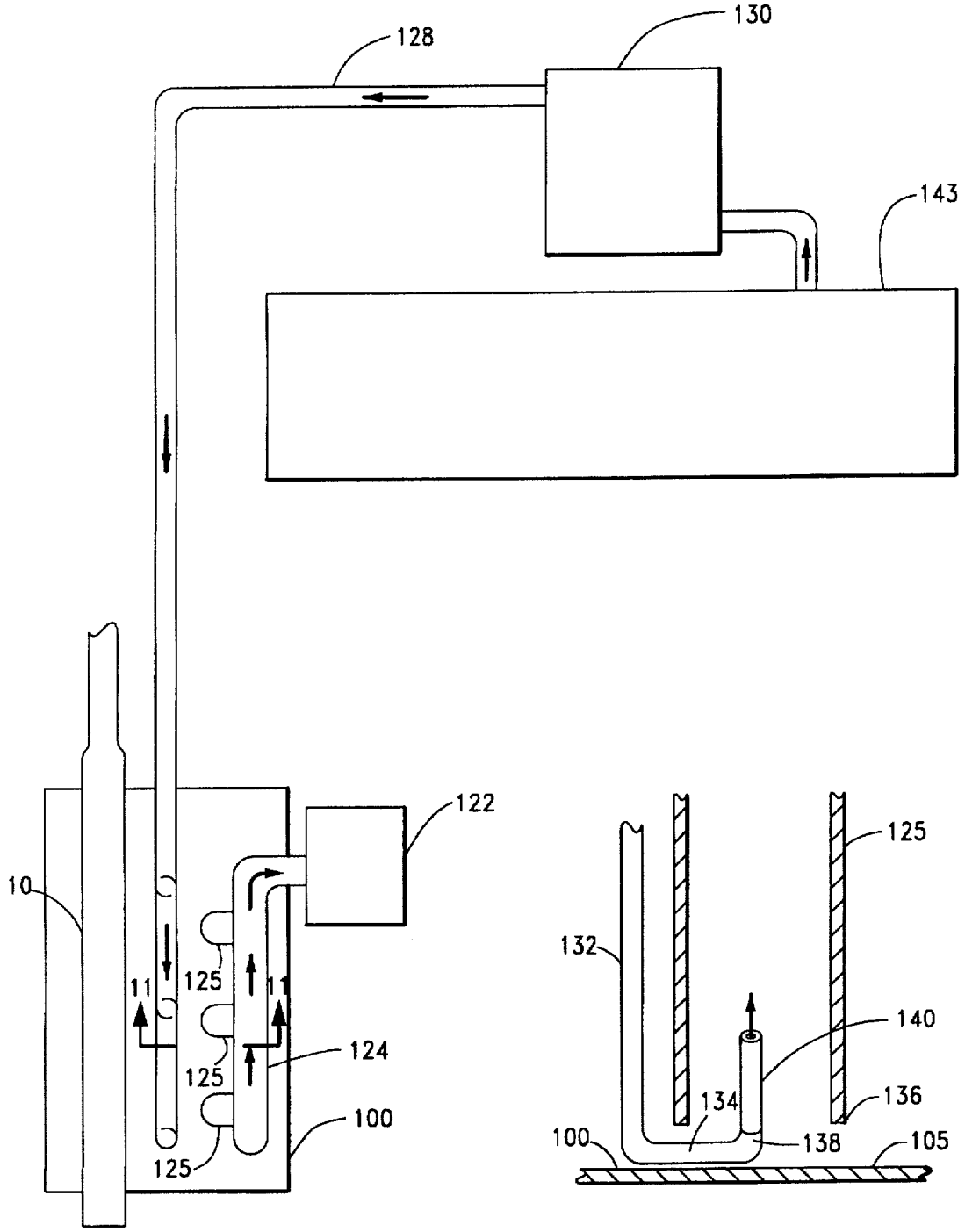
FIG. 10 schematically shows the jetting system used with the separator.
FIG. 11 is a partial section view taken from line 11—11 on FIG. 10 showing the lower end of a waste inlet pipe.

The invention further includes a jetting system 120 communicated with receiving tank 100. The jetting system is shown schematically in FIGS. 1, 5 and 10. Referring now to FIG. 5, the jetting system may include a shale shaker 122 which is schematically shown and which is known in the art. A waste manifold 124 has a plurality of waste inlets 125 extending downward therefrom into the solids and liquids which have been dumped through outlet ports 80 into receiving tank 100. A waste outlet 126 extends from the manifold into the shale shaker. The operation of the jetting system may be described by reference to FIGS. 10 and 11. As shown therein, a discharge line 128 from a rig mud pump 130, is communicated with the receiving tank 100. As shown in FIG. 11, a jetting line 132 will extend downward from discharge line 128 at each location where a waste inlet 125 is located. Each jetting line will extend downward to bottom 105 of tank 100. Each line 132 has a horizontal portion 134 which will pass below a lower end 136 of each waste inlet 125. A vertical portion 138 of jetting line 132 extends upwardly into each waste inlet line 125. A nozzle 140 is connected to vertical portion 138. The exit of nozzle 140 is of much smaller diameter than that of the jetting line 132, so that liquid will exit nozzle 140 in a high velocity jet.

The jetting system operates as follows. Pump 130 will draw liquid, preferably water, from a mud pit 143, or from other liquid supply source. The water will be pumped through discharge line 138 and will exit through nozzles 140. The liquid will exit at a high velocity, creating suction which will cause the liquid and solid mixture in the tank 100 to pass up inlets 125, into manifold 124 and out waste outlet 126 into shale shaker 122. The tank 100 can also be manually cleaned. Although the jetting system described herein utilizes the rig mud pump and mud pit for a liquid supply, the invention is not limited to such features, and other pumps and liquid supplies can be used.

The pit jet system and shale shaker should be run as soon as possible after drilling, preferably as soon as the receiving tank begins to fill. Likewise, dump valve 112 on the vertical separator should be operated regularly to prevent any solids buildup. The shale shaker may be mounted to the side of the receiving tank utilizing brackets 141 above the ground. The shale shaker will dewater the solids which will then be dumped onto the ground. The liquid can be conveyed back into the receiving tank or dumped out into a receiving ditch. (Not shown). The solids can be cleaned as drilling continues since the natural gas and air passes through the separation tube into the secondary separator and out to a burn pit. Circulating pump 63 may also be communicated with the receiving tank through conduit 142 to circulate liquid therefrom. The liquid can be circulated through conduit 65 back into manifold 64 or can be diverted to a holding tank (not shown) through conduit 144 where it can then be taken from the well site.

The operation of the invention is as follows. The exhaust mixture which comprises drill cuttings, drilling air or mist, and liquids and natural gas from the well are received into the horizontal separation tube. Separator liquid is injected into the central flow passage 30 of horizontal separation tube 10 through liquid inlet ports 60 where it interacts with the exhaust mixture. The flow rate of separator liquid through the inlet ports 60 can be regulated by adjusting the inlet valves. The baffles 90 will slow down the flow of the heavier solids and liquids of the exhaust mixture as the natural gas and drilling air passes thereby. The separator liquid will interact with the exhaust mixture, so that the separator liquid, and solid and liquid components of the exhaust mixture will pass through dump outlet ports 80 into receiving tank 100. The dump outlet area can be regulated and adjusted by closing and/or opening any number of dump outlet valves 82. The faster the drilling penetration rate and larger the drill bit size, the greater the separator liquid volume and outlet area required. When mist drilling, a lower separator liquid flow rate will be required to wash the cuttings out of the separation tube since the drilling fluid already contains some liquid. Outlet valves 82 will have to be adjusted depending on the amount of water the well is making. The more water, the larger outlet area required. The natural gas and drilling air will flow into secondary separator 108, where any residual liquids and solids will be separated therefrom. The natural gas and air will then be directed to a burn pit (not shown).

If large amounts of natural gas and/or water are encountered during drilling, the drilling process can be discontinued until it is determined that the separator can safely handle the gas. For larger volumes of natural gas, the best procedure is to turn off the drilling air supply and shut in all outlet valves. Hydraulic control valve can be utilized to simultaneously close annular preventer 40 and open flow through line 52, so that the exhaust mixture will be directed through line 52 to the burn pit. The dump outlet valves and water circulation rate can be slowly readjusted to minimize gas escaping through the dump valves while at the same time preventing excessive water from blowing by the separator tube into the burn pit. Drilling can be resumed at a rate where cuttings are dumped without packing off in the separator. The same procedure can be followed if the blooie line or separator becomes blocked. In other words, the bypass system, which comprises hydraulic flow line 52 and valve 54 shown in the schematic in FIG. 3 can be utilized to divert the exhaust mixture off the separator to allow for cleaning and readjustment of the valves. The hydraulic valve 54 is simply actuated to open flow line 52 and close annular preventer 40 to prevent flow therethrough.

It has been shown that the separator system of this invention provides distinct advantages over the prior art. It is understood that the foregoing description of the invention and illustrative drawings which accompany the same are presented by way of explanation only and that changes may be made by those skilled in the art without departing from the true spirit of the invention. Accordingly, any and all modifications, variations or equivalent apparatus systems or methods which may occur to those skilled in the art should be considered to be within the scope of the invention as defined by the appended claims.

What is claimed is:

1. A separation system for separating an exhaust mixture from a wellbore into its component materials comprising:

a horizontal separation tube for receiving said exhaust mixture from said wellbore, said horizontal separation tube having a length, an entrance end and an exit end, and having a central flow passage, wherein said exhaust mixture is received in said central flow passage of said horizontal separation tube, said exhaust mixture comprising at least a solid component and a gas component, and may include a liquid component;

a liquid inlet port defined in said horizontal separation tube, wherein a separator liquid is injected through said liquid inlet port into said central flow passage along said length of said horizontal separation tube; and a dump outlet port defined in said horizontal separation tube, wherein said exhaust mixture flows in a direction from said entrance end to said exit end, and wherein said separator liquid interacts with said exhaust mixture so that separator liquid and solid and liquid components of said exhaust mixture pass out of said horizontal separator tube through said dump outlet port and the gas component of said exhaust mixture flows through said horizontal separation tube to said exit end.

2. The separation system of claim 1 wherein said liquid inlet port comprises one of a plurality of liquid inlet ports defined in said horizontal separation tube, said inlet ports being spaced along said length of said horizontal separation tube.

3. The separation system of claim 2 further comprising an adjustable inlet valve communicated with each liquid inlet port, said valve being adjustable through a range from fully open to fully closed so that the flow of said separator liquid through each liquid inlet may be regulated.

4. The separation system of claim 1 wherein said dump outlet port comprises one of a plurality of dump outlet ports defined in said horizontal separation tube, said outlet ports being spaced along said length of said separation tube.

5. The separation system of claim 4 further comprising a plurality of deflector plates disposed in said central flow passage.

6. The separation system of claim 5 wherein said plurality of deflector plates comprises one each of said deflector plates corresponding to one of each of said dump outlet ports, so that there are an equivalent number of deflector plates and dump outlet ports.

7. The separation system of claim 4 further comprising an adjustable dump valve communicated with each of said plurality of dump outlets, said dump valves being adjustable from a fully open position to a fully closed position.

8. The separation system of claim 7 wherein said liquid inlet port comprises one of a plurality of separator liquid inlet ports defined in said horizontal separation tube, each of said inlet ports having an adjustable valve communicated therewith, said valves being adjustable through a range from fully open to fully closed.

9. The separation system of claim 8 further comprising:

a receiving tank positioned below said horizontal separation tube for receiving said solid and liquid components of said exhaust mixture from said dump outlet ports; and a jetting system attached to said receiving tank for removing said solids and liquids therefrom.

10. The system of claim 7 wherein said dump valves are remotely operable, so that said dump valves may be alternated between said open and said closed positions from a location remote from said valve.

11. The separation system of claim 1 further comprising a secondary separator connected to said horizontal separation tube at said exit end for receiving the gas component of said exhaust mixture and for separating any separator liquid and any solid and liquid components remaining in said exhaust mixture therefrom.

12. A system for separating an exhaust mixture created during the drilling of a wellbore comprising:

a horizontal separation tube for receiving said exhaust mixture, said horizontal separation tube having a length;

a plurality of inlet ports defined in said separation tube along said length, wherein a separator liquid is injected into said separator tube through at least one of said inlet ports; and a plurality of dump outlet ports defined in said separation tube along said length of said separation tube, wherein said exhaust mixture comprises at least a solid and a gas component and may include a liquid component, and wherein solid and liquid components of said exhaust mixture and separator liquid pass out of said separation tube through at least one of said dump outlet ports.

13. The system of claim 12, further comprising a secondary separator connected to said horizontal separation tube, wherein said secondary separator receives the gas component of said exhaust mixture and separates any residual liquids and solids therefrom.

14. The system of claim 12 further comprising a plurality of baffles disposed in said separation tube for deflecting solid and liquid components of said exhaust mixture toward said dump outlet ports.

15. The system of claim 12 further comprising a receiving tank positioned to receive said solid component and any liquid component of said exhaust mixture along with said separator liquid from said dump outlet ports.

16. The system of claim 15 further comprising a jetting system communicated with said tank to remove said solids and said liquids from said tank wherein said jetting system separates said solids from said liquids.

17. The system of claim 12 wherein said exhaust mixture flows in a direction from an entrance end to an exit end of said separation tube, and wherein solid and liquid components of said exhaust mixture are dumped through said dump outlet ports, wherein said gas component flows to said exit end of said separation tube.

18. The system of claim 12 further comprising:

each of said inlet ports having an adjustable inlet valve communicated therewith; and each of said dump outlet ports having an outlet valve communicated therewith, said outlet valves being adjustable from an open to a closed position.

19. The system of claim 18 wherein said outlet valves are remotely operable valves, so that said valves may be adjusted between said open and closed positions from a location remote from said outlet valve location.

20. A method of separating an exhaust mixture from a wellbore into its individual components, said mixture having at least a solid and a gas component, said method comprising the steps of:

directing said exhaust mixture into a separation chamber, said separation chamber including an entrance and an exit wherein said exhaust mixture flows in a direction from said entrance to said exit;

injecting a separator liquid into said separation chamber transverse to the flow direction of said exhaust mixture; and removing solid and liquid components of said exhaust mixture and separator liquid from said separation chamber between said entrance and said exit of said separation chamber as said exhaust mixture passes therethrough.

21. The method of claim 20 wherein said separation chamber is a horizontal separation chamber, and wherein said removing step comprises directing said separation liquid and solid and liquid components of said exhaust mixture through openings in a bottom of said chamber as said gas component of said mixture flows from said entrance to said exit.

22. The method of claim 20 further comprising:

regulating the flow of said separator liquid into said separation chamber based on the flow rate of said exhaust mixture; and regulating the area of the opening in the separation chamber so that said solid and liquid components will pass out of said separation chamber and said gas will flow to said exit.

23. The method of claim 22 further comprising communicating said exit end with a secondary separator, so that said secondary separator receives said gas and any remaining solids and liquids.

* * * * *